United States Patent [19]

Smith et al.

[11] Patent Number: 4,919,415

[45] Date of Patent: Apr. 24, 1990

[54] MULTIPLE DELIVERY SYSTEM

[75] Inventors: David A. Smith, Midland; Clark M. Woody, Bay City, both of Mich.

[73] Assignee: The Dow Chemical Company, Midland, Mich.

[21] Appl. No.: 159,133

[22] Filed: Feb. 23, 1988

[51] Int. Cl.[5] ..... B65H 29/24

[52] U.S. Cl. ..... 271/284; 271/196

[58] Field of Search ..... 271/196, 276, 283, 284, 271/94, 279, 287; 209/553

[56] References Cited

U.S. PATENT DOCUMENTS

| | | | |
|---|---|---|---|
| Re. 28,172 | 9/1974 | Bradley et al. . | |
| 2,997,174 | 8/1961 | Hayes | 209/553 |
| 3,023,894 | 3/1962 | Wiener | 209/553 |
| 3,067;871 | 12/1962 | Lyon | 209/553 |
| 3,224,578 | 12/1965 | Oberman | 209/553 |
| 3,254,889 | 6/1966 | Nystrand . | |
| 3,498,600 | 3/1970 | Spencer et al. . | |
| 3,599,805 | 8/1971 | Spencer et al. . | |
| 3,640,050 | 2/1972 | Nystrand et al. . | |
| 3,842,568 | 10/1974 | Spencer . | |
| 4,157,178 | 6/1979 | Ollendick | 271/196 X |
| 4,270,910 | 6/1981 | Himmelsbach | 271/196 X |
| 4,300,893 | 11/1981 | Achelpohl et al. . | |
| 4,471,955 | 9/1984 | Bradley et al. . | |
| 4,523,671 | 6/1985 | Campbell . | |
| 4,754,962 | 7/1988 | Kontz | 271/196 X |

*Primary Examiner*—Richard A. Schacher

[57] ABSTRACT

A high speed product delivery system is provided which delivers individual flexible web products from a product drum to a plurality of transfer drums. The transfer drums, in turn, deliver products to further transfer drums or to packaging devices. The system permits increases in the production rate of the products without increasing the demand on the packaging devices.

9 Claims, 2 Drawing Sheets

MULTIPLE DELIVERY SYSTEM

BACKGROUND OF THE INVENTION

This invention relates to apparatus for delivering individual flexible web products, and more particularly it relates to a high speed delivery system for plastic bags and containers.

In the production of individual flexible web products such as plastic bags and containers, the bag stock is typically supplied in the form of a continuous web of thermoplastic material which has been folded upon itself to form two plies. In forming individual plastic bags and containers, portions of the thermoplastic material are severed from the web. These severed areas also become side seams for the bags because they are typically sealed at the same time as they are severed by the use of a heated wire element. The plastic bags are then stacked, counted, and packaged by packing equipment.

The severing and sealing operation typically takes place on a relatively large diameter rotating drum which may contain multiple heated wire severing and sealing elements positioned in grooves located within the outer periphery of the drum. See, for example, Tumminia U.S. Pat. No. 4,369,449, assigned to the same assignee as the present inventors. As the drum rotates, different severing and sealing elements are actuated to raise them up to the drum surface to sever and seal a respective portion of the web of bag stock. The individual bags are retained on the drum by a vacuum arrangement as the drum rotates. Such drums are large and expensive pieces of equipment. However, they can presently be operated at production speeds in excess of the production speed of the packaging equipment.

Individual bags are then taken from the drum, stacked, and packaged. See, for example, U.S. Pat. Nos. Re 28,172, 3,254,889, 3,599,705, 3,640,050, and 3,842,568, for a description of typical stacking and packing apparatus. Desirably, the packaging operation occurs at the highest possible speed the equipment can be operated to increase productivity of the system. As shown in the above mentioned Pats., presently, individuals bags are taken from the drum by a smaller drum, also suitably equipped with vacuum capabilities. The vacuum on the bags on the large drum is relieved at an appropriate point, and the bags fall onto the smaller drum where they are held in position by vacuum. At an appropriate point, the vacuum is released and the individual bags are pulled off the smaller drum by an orbital packer or similar device.

As is conventional, the orbital packing device is provided with a set of packer fingers which move in a circular path in precise timing with the smaller drum so that the fingers remove each successive bag from the drum and stack them. After a predetermined number of bags have been removed, count fingers or other suitable separation means are actuated to separate the continuous stream of individual bags into precounted stacks.

To accomplish this, the count fingers must move from a first position fully out of the stream of bags, to a second position fully in the stream. This movement must be accomplished in the fraction of a second between successive bags as they are delivered from the smaller drum. At high production rates, this time can be less than 0.1 seconds. This results in the production of tremendous acceleration forces on the count fingers as high as 30 times the force of gravity. High inertial forces also affect the remainder of the packaging system for the folding and loading of the product into dispensers. Thus, operation at the design limits of the packing equipment results in high inertial loading which is detrimental to machinery life and results in excessive downtime and maintenance costs.

Accordingly, it would be desirable to be able to utilize the capability of the product drum to produce products at the higher rates that it is capable of, and yet maintain or even increase the higher production rates without subjecting the packaging system to such high inertial forces. The need exists in the art for such a high speed delivery system.

SUMMARY OF THE INVENTION

The present invention meets that need by providing a high speed product delivery system which increases the production rate of the system without subjecting the system to increased inertial loading of the equipment. According to one aspect of the present invention, the delivery system includes means for providing a series of individual flexible products, such as plastic bags or containers, sequentially to a transfer point including a vacuum product drum and means for rotating the drum. The vacuum product drum conveys individual products, such as individual plastic bags or containers to the transfer point As is conventional, the product drum contains multiple heated severing and sealing elements which produce individual products from the continuous web of thermoplastic material.

The system also includes means for transferring individual ones of the products from the transfer point to a plurality of delivery points where the products will be stacked and packaged in a conventional manner. The transfer means includes a plurality of vacuum transfer drums and means for rotating those drums. The transfer drums are arranged so that the first of the transfer drums accepts products from the product drum and then transfers at least a portion of those products to a succeeding transfer drum. At least a portion of the products are also sent to a first delivery point.

The products which are transferred to a succeeding transfer drum may then also be split in the same manner with some being sent to yet another transfer drum and some being sent to a second delivery point. At the final in the series of transfer drums, all remaining products are delivered to a final delivery point. At each delivery point, packaging machinery is provided to stack, count, and package the individual products. The packaging machinery may be orbital packing apparatus or the like, such as that shown in Re 28,172, the disclosure of which is hereby incorporated by reference.

For example, where two transfer drums are utilized, the first transfer drum will transfer every other product to the second transfer drum. Each of the transfer drums is equipped with a vacuum arrangement including a plurality of vacuum ports in communication with a source of vacuum. The vacuum ports extend radially outwardly from the centers of the transfer drums. The vacuum ports are arranged so that, as the transfer drums rotate, every other product is transferred from the first onto the second transfer drum, preferably, this transfer takes place at a point approximately along the centerline between the two drums.

In an alternate embodiment of the invention, the high speed delivery system includes means for providing a series of individual flexible products sequentially to a plurality of transfer points positioned about the periphery of a product drum. The delivery system includes a vacuum product drum which conveys the individual products to each of the transfer points, and means to rotate the drum.

The system also includes means for transferring individual products from each of the transfer points to a plurality of corresponding delivery points. At the delivery points, the products are stacked, counted, and packaged by machinery such as an orbital packaging apparatus. The transfer means include a plurality of vacuum transfer drums and means for rotating those drums. The drums are so arranged that the first of the transfer drums accepts individual products from the product drum at the first transfer point, while succeeding transfer drums accept products from the product drum at succeeding transfer points.

At each transfer drum, at least a portion of the products on the product drum are transferred by means of a vacuum arrangement on the drums. Vacuum sources in each drum communicate with vacuum ports which extend radially outwardly from the drums. The products on the transfer drum are then themselves delivered, by rotation of the drum, to a respective delivery point. The transfer drums are designed to remove individual products from the product drum as it rotates so that as the last transfer drum is reached, all products have been transferred.

In conventional packaging systems, the maximum number of products which can be produced is limited by the capabilities of the packaging portion of the system. By providing a pluralitY of delivery points, the number of packaging apparatuses can be increased for a single product drum. This enables the product drum to be operated at much higher speeds. In this manner, the effective speed of the delivery system can be doubled or tripled without exceeding the design specifications of the packaging equipment.

For example, if it is assumed that a standard packaging apparatus can stack, count, and package 100 individual products per minute, the practice of the present invention can double or triple that production rate. In previous systems, 100 products per minute would be the maximum production rate for the system without exceeding design specifications for the equipment.

With the use of two transfer drums and corresponding delivery points, two packaging apparatuses can be used, effectively doubling the rate of production of the system to 200 products per minute. Likewise, the use of three transfer drums can effectively triple the production rate of the system. Additionally, where downtime and maintenance costs are excessive for packaging systems operated at the design limits of such systems, the delivery system of the present invention permits increases in overall production rates while actually operating the packaging equipment at lower speeds than before.

Accordingly, it is an object to the present invention to provide a high speed delivery system which can increase the rate of production of the system without subjecting the packaging apparatus to inertial forces in excess of design specifications. This, and other objects and advantages of the present invention, will become apparent from the following detailed description, the accompanying drawings, and the appended claims.

DESCRIPTION OF THE PREFERRED EMBODIMENTS

Figure 1:
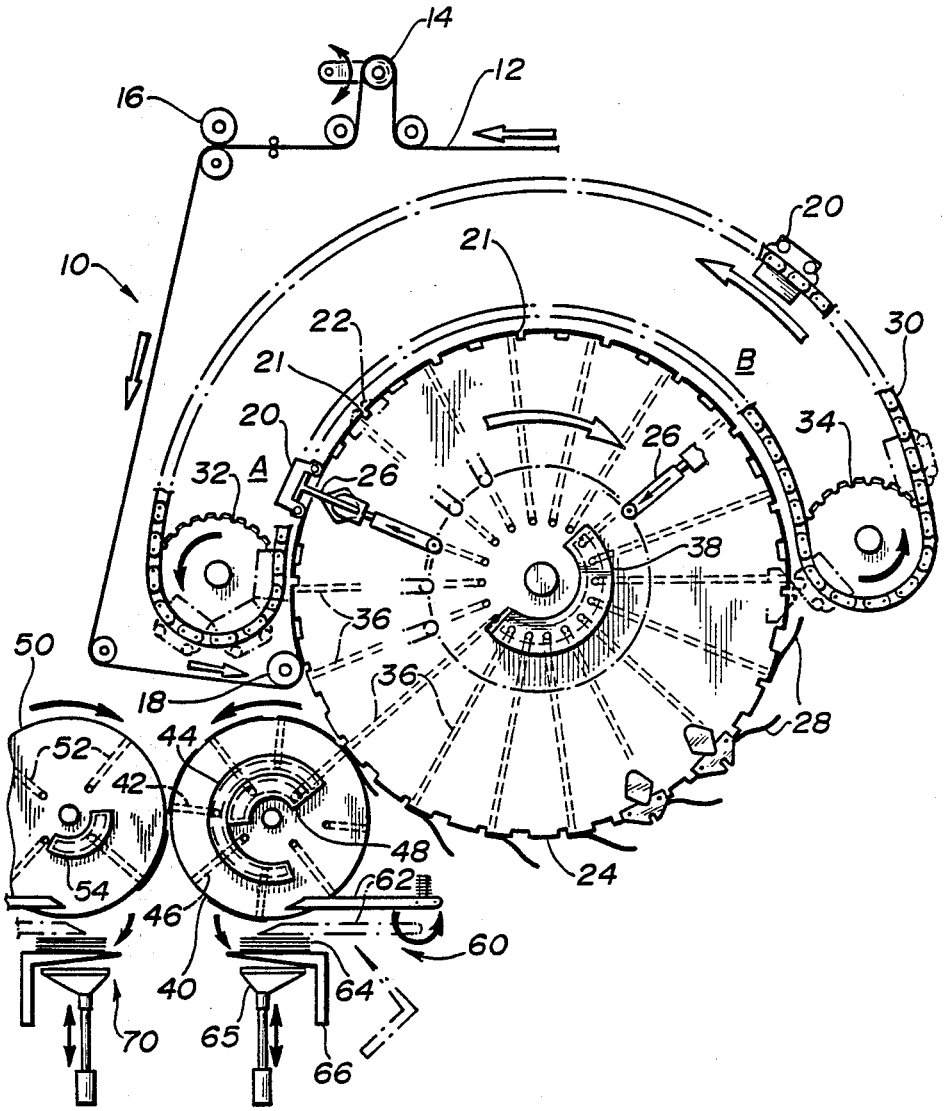
FIG. 1 is a schematic side elevational view of one embodiment of the delivery system of the present invention.

Referring now to FIG. 1, the delivery system of the present invention is illustrated in schematic form. Delivery system 10 receives a continuous web, designated film web 12 from a spool (not shown) or directly from an extrusion line. While the invention will be described in the context of a web of thermoplastic material used to form individual plastic bags or containers, it will be apparent to those skilled in the art that the delivery system of the present invention is applicable to other products which are fed from a continuous web and then divided into individual flexible products.

Film web 12 may either be a zippered or unzippered bag stock being folded on itself to provide a two ply film. Film web 12 is caused to pass over dancer roll 14 which acts to control film web tension based on its vertical positioning. Film web 12 is then pulled through a draw-roll arrangement 16 which is driven at a speed slightly in excess of the rotational speed of product drum 24. This type of operation permits some slack in the film as it is being fed onto vacuum product drum 24. Vacuum product drum 24 is driven by drive means (not shown) in a conventional manner. The film web 12 then passes over a lay-on roll 18 which is located to position the film web accurately against the rotating vacuum product drum surface.

Film web 12 is then severed and sealed on product drum 24 in the following manner. Film web 12 is clamped tightly to the outer surface of vacuum product drum 24 at a severing and sealing edge of a heating element slot 21 by seal bar assembly 20. Each seal bar assembly 20 is aligned in proper position over a corresponding heating element slot 21 on the vacuum product drum 24. As vacuum product drum 24 rotates in the direction of the arrow, a heated wire severing and sealing element, shown generally at 26, operable through a cam assembly (not shown), emerges from a recess in vacuum product drum 24 and severs film web 12 at position A.

The severing and sealing element 26 is then withdrawn as shown schematically at position B. During the time that the element is extended, the film melts back to the edge of the seal bar assembly 20 and a bead seal forms on the edge of the bag. Individual flexible products in the form of individual plastic bags 28 are formed by the severing and sealing of film web 12 on adjacent seal bar assemblies.

Just prior to the release of the clamping force of the seal bar assembly 20, a vacuum is applied either to the leading edge of individual plastic bags 28 or to both the leading and trailing edges. Seal bar assembly 20 is removed from the product drum by a continuous chain drive 30 having sprockets 32 and 34 located on opposite sides of product drum 24. The chain drive permits precise positioning of the individual seal bar assemblies 20 along the surface of the vacuum product drum.

Individual plastic bags 28 are held in position on rotating vacuum product drum 20 by respective vacuum ports 36 which communicate with a central manifold 38, which in turn communicates with a vacuum source (not shown). As shown, as vacuum product drum 24 rotates, vacuum ports 36 are brought into and out of communication with manifold 38. This construction causes a vacuum to be applied to the edge of bags 28 beginning at a point just prior to the removal of seal bar assembly 20 until transfer to first transfer drum 40.

Bags 28 are held onto rotating first vacuum transfer drum 40 by a similar vacuum system. A first set of vacuum ports 42 communicate with a first central manifold 44, which in turn communicates with a vacuum source (not shown). A second set of vacuum ports 46 communicate with a second central manifold 48, which in turn communicates with a vacuum source. As shown, at a point approximately along a line between the centers of product drum 24 and first vacuum tranSfer drum 40, the vacuum is relieved from vacuum product drum 24. Gravity then causes the bags 28 to fall toward transfer drum 40 where a corresponding vacuum port 42 is activated.

The first and second sets of vacuum ports 42 and 46 on vacuum transfer drum 40 are positioned so that each individual plastic bag 28 is removed from the vacuum product drum. As shown, each set of vacuum ports is active during rotation of first vacuum transfer drum 40 until a point approximately along the centerline between first vacuum transfer drum 40 and second vacuum transfer drum 50. At that point, bags 28 secured to vacuum ports 46 will be released and then picked up by the vacuum system on second vacuum transfer drum 50. Bags 28 will be transferred to second vacuum transfer drum 50 by vacuum ports 52 which communicate with a central manifold 54.

In this manner, the stream of individual plastic bags may be divided into two streams which can then be delivered to separate packaging devices 60 and 70. The operation of packaging devices 60 and 70 are the same and will be described in greater detail in relation to device 60. As bags 28 are brought around first transfer drum 40, vacuum ports 42 hold onto bags 28 until they reach a nearly horizontal position where the vacuum is released.

In packaging device 60, orbital packer fingers 62 pull the individual plastic bags away from the drum surface and deposit the bags into a stack 64 on delivery table 65. At a precise time, count fingers 66 pivot between the position shown in phantom lines completely out of the stream of bags into the position shown to separate the stack 64 of bags into the desired count. The delivery table 65 may be lowered to permit a clamp assembly (not shown) to clamp the stack of bags and transfer it to further conventional equipment for packaging the bags.

Figure 2:
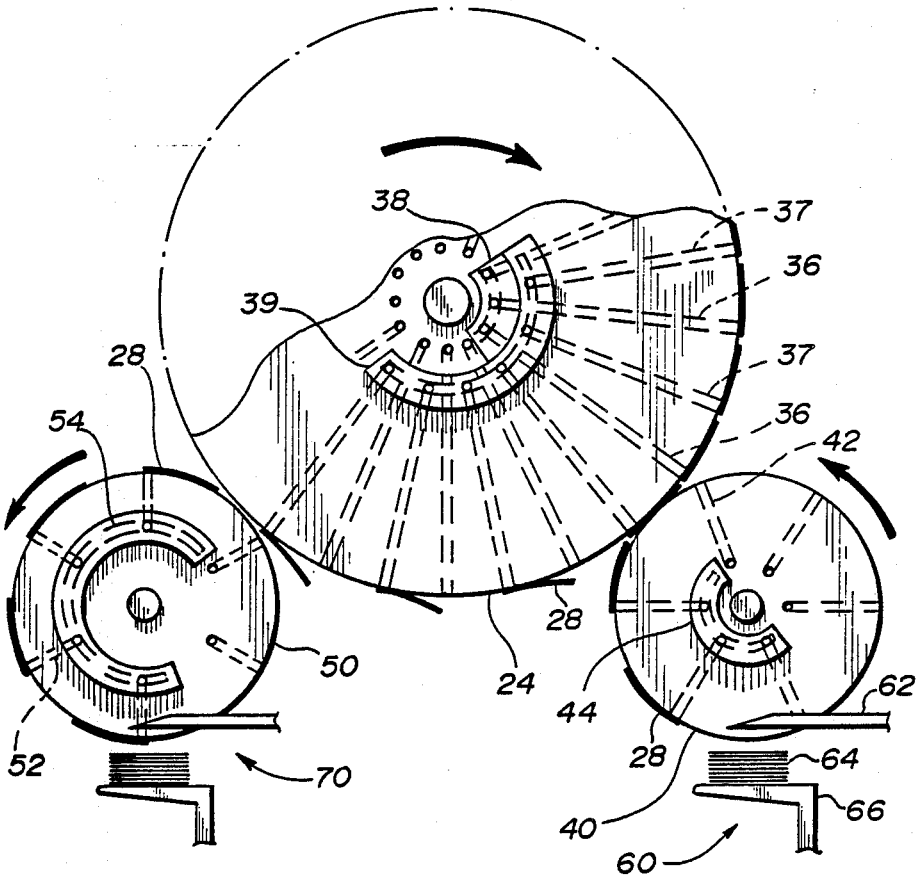
FIG. 2 is a schematic side elevational view of another embodiment of the delivery system of the present invention.

In an alternate embodiment of the invention illustrated in FIG. 2, where like reference numerals represent like elements, the first and second transfer drums 40 and 50, respectively, are positioned at different transfer points around the periphery of product drum 24. As shown, in this embodiment, product drum 24 is equipped with a first set of vacuum ports 36 as well as a second set of ports 37. Each set of ports communicates with a respective central manifold 38, 39. With the product and transfer drums rotating in the directions indicated by the arrows, it can be seen that the vacuum on ports 36 is released at a point approximately along the centerline between the product drum 24 and first transfer drum 40.

Bags 28 transferred to first transfer drum 40 are then delivered to packaging device 60 for stacking and counting as previously described. That portion of the bags which are held by ports 37 are carried with product drum 24 until the vacuum is released at a point approximately along the centerline between product drum 24 and second transfer drum 50. Again, bags which are released to second transfer drum 50 are then delivered to packaging device 70 for stacking and counting.

As will be recognized by those skilled in the art, modifications to the embodiments illustrated in FIGS. 1 and 2 can be made. For example, the FIG. 1 embodiment can be arranged to have a third and/or fourth transfer drum. The vacuum ports on the product drum and each of the transfer drums can be arranged so that a portion of the individual bags are delivered to each transfer drum, and from there to corresponding packaging devices. Such arrangements will be effective to triple or quadruple the production rate from the system with increasing the rate of operation of any of the individual packaging devices.

Additionally, with respect to the FIG. 2 embodiment, additional transfer drum may be positioned beside the respective first and second transfer drums. By modifying the arrangement of the vacuum ports on each drum, a portion of the bags from the product drum can be delivered to each transfer drum and then to a corresponding packaging device. Again, the production rate of the system is increased without increasing the rate of operation of any individual packing device.

It can also be seen that different width bags may be produced on the product drum, with every other bag being of an alternating width. For example, the spacing between adjacent sever and seal stations on the product drum may be changed so that the spacing corresponds to such alternating widths. Of course, the vacuum ports on both the product drum and first transfer drum would be changed to correspond to the new spacing arrangement. The alternating width bags may then be sent to the transfer drums where bags of each specific width are delivered to a separate packaging device. In this manner, the different width (and thus, volume) bags are separately packed and packaged for use.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A high speed product delivery system comprising:

means for providing a series of individual flexible web products sequentially to a plurality of transfer points, said providing means including a vacuum product drum for conveying said individual products to each of said plurality of transfer points, means for rotating said drum, said vacuum product drum including a plurality of vacuum ports for securing a plurality of said individual products to said vacuum product drum during rotation thereof, means for transferring individual ones of said products from each of said plurality of transfer points to a plurality of delivery points, said transfer means including a plurality of vacuum transfer drums, means for rotating said drums, said drums arranged such that the first of said plurality of transfer drums accepts products from said product drum at a first transfer point and each succeeding transfer drum accepts individual products from said vacuum product drum at each succeeding transfer point, said first transfer drum delivering at least a portion of said individual products to a first delivery point, and each succeeding transfer drum located at each succeeding transfer point delivering at least a portion of said individual products to succeeding delivery points, and packing devices located adjacent each of said delivery points for removing said flexible products from said vacuum transfer drum, said packing devices including orbital packing fingers to contact and remove said flexible products.

2. The high speed product delivery system of claim 1 which includes means located at each of said delivery points for removing individual products from each of said transfer drums.

3. The high speed delivery system of claim 1 including means for transferring every other product from said product drum to said first transfer drum.

4. The high speed delivery system of claim 3 in which said means for transferring every other product includes a vacuum source in said first transfer drum, a plurality of vacuum ports in communication with said vacuum source and extending substantially radially outwardly from the center of said first transfer drum, said vacuum ports being so arranged that as said first transfer drum rotates, every other individual product on said product drum is pulled onto said first transfer drum.

5. The high speed delivery system of claim 4 in which the vacuum on said vacuum product drum is relieved at a point adjacent said first transfer drum.

6. A high speed product delivery system comprising:

means for providing a series of individual flexible web products sequentially to a plurality of transfer points, said providing means including a vacuum product drum for conveying said individual products to each of said plurality of transfer points, and means for rotating said drum, and means for transferring individual ones of said products from each of said plurality of transfer points to a plurality of delivery points, said transfer means including a plurality of vacuum transfer drums, means for rotating said transfer drums, and a vacuum source in each of said transfer drums in communication with a plurality of vacuum ports on the surface of said drums, said vacuum ports being arranged that as each of said transfer drums rotates, individual products from said product drum are pulled onto said transfer drums, said drums arranged such that the first of said plurality of transfer drums accepts products from said product drum at a first transfer point and each succeeding transfer drum accepts individual products from said vacuum product drum at each succeeding transfer point, said first transfer drum delivering at least a portion of said individual products to a first delivery point, each succeeding transfer drum located at each succeeding transfer point delivering at least a portion of said individual products to succeeding delivery points, and packing devices located adjacent each of said delivery points for removing said flexible products from said vacuum transfer drum, said packing devices including orbital packing fingers to contact and remove said flexible products.

7. A high speed product delivery system comprising:

means for providing a series of individual flexible web products sequentially to a plurality of transfer points, said providing means including a vacuum product drum for conveying said individual products to each of said plurality of transfer points, and means for rotating said drum, and means for transferring individual ones of said products from each of said plurality of transfer points to a plurality of delivery points, said transfer means including a plurality of vacuum transfer drums, means for rotating said drums, said drums arranged such that the first or said plurality of transfer drums accepts every other product from said product drum at a first transfer point said first transfer drum including a vacuum source, a plurality of vacuum ports in communication with said vacuum source and extending substantially radially outwardly from the center of said first transfer drum, said vacuum ports being so arranged that as said first transfer drum rotates, every other individual product on said product drum is pulled onto said first transfer drum, and each succeeding transfer drum accepts individual products from said vacuum product drum at each succeeding transfer point, said first transfer drum delivering at least a portion of said individual products to a first delivery point, and each succeeding transfer point delivering at least a portion of said individual products to succeeding delivery points, and means adjacent each of said delivery points for removing said individual products from respective transfer drums.

8. A method for the high speed delivery of a plurality of individual flexible plastic bags to a plurality of delivery points, comprising the steps of:

providing a series of individual flexible plastic bags sequentially to a plurality of transfer points by securing a plurality of said bags to a rotating vacuum product drum, transferring individual ones of said bags from said product drum to each of said plurality of transfer points by relieving the vacuum on the product drum at points adjacent respective ones of said transfer points and securing said bags to respective rotating vacuum transfer drums, and delivering said bags to a plurality of delivery points by pulling said bags from said respective transfer drums at said delivery points.

9. The method of claim 8 in which every other one of said bags is transferred at a first transfer point.

* * * * *